US012622519B2

(12) United States Patent
Faizan et al.

(10) Patent No.: US 12,622,519 B2
(45) Date of Patent: May 12, 2026

(54) STABILIZER SYSTEM FOR CONTROLLING TIPPING OF FURNITURE

(71) Applicant: Mirza Faizan, Irving, TX (US)

(72) Inventors: Mirza Faizan, Irving, TX (US); Isha Agrawal, Plano, TX (US); Nithyashri Ramesh, Irving, TX (US); Sooryavanshi Narayanan, Frisco, TX (US); Sanjiv Sridharan, Irving, TX (US); Hisham Ahmad, Allen, TX (US); Vishy Narayanan, Frisco, TX (US); Sheza Asif, Parker, TX (US); Nihal Yerubandi, SouthLake, TX (US); Sparsh Kamdar, Plano, TX (US); Nakshatra Piduri, Plano, TX (US); Mirza Rizwan, Patna (IN); Ashaz Haque, Patna (IN); Aarifa Fatima, Patna (IN); Raahi S Jogani, Sunnyvale, TX (US); Sofia Sethuraman, Dallas, TX (US); Saadia Asaf, Aligarh (IN); Mansoor Hasan Khan, Aligarh (IN)

( * ) Notice: Subject to any disclaimer, the term of this patent is extended or adjusted under 35 U.S.C. 154(b) by 113 days.

(21) Appl. No.: 18/581,067

(22) Filed: Feb. 19, 2024

(65) Prior Publication Data

US 2025/0261756 A1 Aug. 21, 2025

(51) Int. Cl.
*A47B 97/00* (2006.01)

(52) U.S. Cl.
CPC ..... *A47B 97/00* (2013.01); *A47B 2097/008* (2013.01)

(58) Field of Classification Search
CPC .... A47B 97/00; A47B 97/02; A47B 2097/008
USPC ..... 248/500
See application file for complete search history.

(56) References Cited

U.S. PATENT DOCUMENTS 989,085 A * 4/1911 Turton ..... A47B 97/00 248/680
2,769,275 A * 11/1956 Lindgren ..... A47B 95/043 248/345.1
2,854,785 A * 10/1958 Sperlich ..... A47B 97/00 248/188.1
3,030,061 A * 4/1962 Jennings ..... E04G 17/14 403/53
4,304,078 A * 12/1981 Meriwether, Jr. ... E04F 21/0015 403/53
5,590,619 A * 1/1997 Meador ..... B63B 29/06 248/500

(Continued)

*Primary Examiner* — Nkeisha Smith

(57) ABSTRACT

A stabilizer system for controlling a tipping of a furniture includes at least one stabilizer assembly coupled to a wall and including a telescopic rod configured to telescopically extend and retract and an engagement structure coupled to the telescopic rod, and configured to be arranged in an expanded configuration and a stowed configuration. In the expanded configuration, the engagement structure is arranged to contact the furniture. A plurality of weight sensors is coupled to the furniture and configured to detect a weight imbalance of the furniture. A controller is configured to extend the telescopic rod to engage the at least one stabilizer assembly with the furniture to prevent the tipping of the furniture in response to the detected weight imbalance being above a predefined limit.

12 Claims, 3 Drawing Sheets

(56) References Cited

U.S. PATENT DOCUMENTS 5,690,311 A * 11/1997 Leighton ..... B01L 9/50 248/500
8,061,676 B1 * 11/2011 Kumar ..... A47C 7/62 248/500
8,087,624 B2 * 1/2012 Varney ..... F16M 11/10 248/917
8,727,300 B2 * 5/2014 Maier ..... F16M 7/00 248/300
9,163,842 B2 * 10/2015 Adams ..... A47B 91/08
9,709,216 B2 * 7/2017 Zing ..... F16B 9/05
10,017,100 B2 * 7/2018 Parrin ..... B60P 7/0807
10,362,873 B1 * 7/2019 Farnsworth ..... F16B 1/00
10,405,647 B2 * 9/2019 Laudadio ..... A47B 21/02
10,451,293 B2 * 10/2019 Kobos ..... A47B 77/022
10,501,991 B2 * 12/2019 Umlor ..... E06C 7/48
10,912,384 B2 * 2/2021 Lager ..... A44B 11/00
11,375,814 B1 * 7/2022 Stravitz ..... F16M 11/22
11,647,840 B2 * 5/2023 Nelson ..... A47C 7/624 297/217.6
12,327,279 B2 * 6/2025 Faizan ..... G06T 19/20
2009/0173848 A1 * 7/2009 Green ..... F16M 11/28 248/291.1
2011/0121156 A1 * 5/2011 Lee ..... A47B 23/043 248/463
2013/0087675 A1 * 4/2013 Miller ..... A47B 97/00 248/499
2019/0000232 A1 * 1/2019 Une ..... A47B 97/00
2019/0008277 A1 * 1/2019 Sekine ..... A47B 97/00
2019/0008278 A1 * 1/2019 Une ..... A47B 97/00
2019/0017564 A1 * 1/2019 Sekine ..... F16F 9/516
2019/0021497 A1 * 1/2019 Sekine ..... A47B 95/00
2019/0021499 A1 * 1/2019 Nakazato ..... A47B 95/00
2019/0029423 A1 * 1/2019 Sekine ..... F16F 9/061
2019/0053617 A1 * 2/2019 Laudadio ..... F16M 11/00
2019/0142161 A1 * 5/2019 Mori ..... F16F 15/023 248/500
2019/0142162 A1 * 5/2019 Tokuda ..... A47B 97/00 248/500
2020/0229601 A1 * 7/2020 Ishihara ..... A47B 97/00
2022/0015968 A1 * 1/2022 Crealey ..... A61G 5/10

* cited by examiner

STABILIZER SYSTEM FOR CONTROLLING TIPPING OF FURNITURE

TECHNICAL FIELD

The present disclosure relates, generally, to a stabilizer system for a furniture, and more particularly relates to a stabilizer system suitable to prevent a tipping or overturning of the furniture.

BACKGROUND

Furniture Tip-Over is when furniture falls onto someone, because of stability, which is undesirable.

SUMMARY

One aspect of the disclosure relates to a stabilizer system for controlling a tipping of a furniture. The stabilizer system includes at least one stabilizer assembly coupled to a wall. The at least one stabilizer assembly includes a telescopic rod configured to telescopically extend and retract. The telescopic rod has a first end attached to the wall and a second end arranged distally from the wall. Further, the at least one stabilizer assembly includes an engagement structure coupled to the second end of the telescopic rod, and configured to be arranged in an expanded configuration and a stowed configuration and biased to the expanded configuration. In the expanded configuration, the engagement structure is arranged to contact the furniture. The stabilizer system includes a plurality of weight sensors coupled to the furniture and configured to detect a weight imbalance of the furniture. Further, the stabilizer system includes a controller arranged in communication with the plurality of weight sensors and the at least one stabilizer assembly and configured to extend the telescopic rod to engage the engagement structure with the furniture to prevent the tipping of the furniture in response to the detected weight imbalance being above a predefined limit.

In some additional, alternative, or selectively cumulative embodiments, the engagement structure includes an elongated rod rotatably attached to the second end of the telescopic rod and is adapted to move between a first position and a second position and is biased to the first position.

In some additional, alternative, or selectively cumulative embodiments, the engagement structure includes a spring biasing the elongated rod to the first position.

In some additional, alternative, or selectively cumulative embodiments, in the expanded configuration, the elongated rod is arranged in the first position and is adapted to contact the furniture to prevent the tipping of the furniture, and in the stowed configuration, the elongated rod is arranged in the second position.

In some additional, alternative, or selectively cumulative embodiments, the telescopic rod includes a main tube and at least one auxiliary tube configured to telescopically extend and retract relative to the main tube. Also, the at least one auxiliary tube defines an axially extending groove and the elongated rod is arranged inside the groove, in the second position.

In some additional, alternative, or selectively cumulative embodiments, the engagement structure includes a spring loaded pin coupled to the elongated rod and adapted to extend inside an opening of the at least one auxiliary tube in the first position of the elongated rod to prevent a rotation of the elongated rod relative to the at least one auxiliary tube.

In some additional, alternative, or selectively cumulative embodiments, the stabilizer system includes at least one actuator operatively coupled to the telescopic rod to extend and retract the telescopic rod.

In some additional, alternative, or selectively cumulative embodiments, the controller is arranged in communication with the at least one actuator and configured to operate the at least one actuator to control the extension and retraction of the telescopic rod based on input from the plurality of weight sensors.

In accordance with another embodiment of the disclosure, a stabilizer system for controlling a tipping of a furniture is disclosed. The stabilizer system includes at least one stabilizer assembly coupled to a wall and including a telescopic rod having a main tube attached to the wall and at least one auxiliary tube arranged to telescopically extend and retract relative to the main tube. Further the at least stabilizer assembly further includes an elongated rod pivotally coupled to the at least one auxiliary tube and adapted to pivot between a first position and a second position. Moreover, the elongated rod is biased to the first position. In the first position, the elongated rod is arranged to contact the furniture. Further, the stabilizer system includes a plurality of weight sensors coupled to the furniture and configured to detect a weight imbalance of the furniture. Furthermore, the stabilizer system includes a controller arranged in communication with the plurality of weight sensors and the at least one stabilizer assembly and configured to extend the at least one auxiliary tube to engage the associated elongated with the furniture to prevent the tipping of the furniture in response to the detected weight imbalance being above a predefined limit.

In some additional, alternative, or selectively cumulative embodiments, a spring biases the elongated rod to the first position.

In some additional, alternative, or selectively cumulative embodiments, the at least one auxiliary tube defines an axially extending groove and the elongated rod is arranged inside the groove, in the second position.

In some additional, alternative, or selectively cumulative embodiments, at least one stabilizer assembly includes a spring loaded pin coupled to the elongated rod and adapted to extend inside an opening of the at least one auxiliary tube in the first position of the elongated rod to prevent a rotation of the elongated rod relative to the at least one auxiliary tube.

In some additional, alternative, or selectively cumulative embodiments, the stabilizer system also includes at least one actuator operatively coupled to the at least one auxiliary tube to extend the at least one auxiliary tube.

In some additional, alternative, or selectively cumulative embodiments, the controller is arranged in communication with the at least one actuator and configured to operate the at least one actuator to control the extension of the at least one auxiliary tube based on input from the plurality of weight sensors.

BRIEF DESCRIPTION OF THE ACCOMPANYING DRAWINGS

Having thus described example embodiments of the present disclosure in general terms, reference will now be made to the accompanying drawings, which are not necessarily drawn to scale, and wherein:

Figure 4:
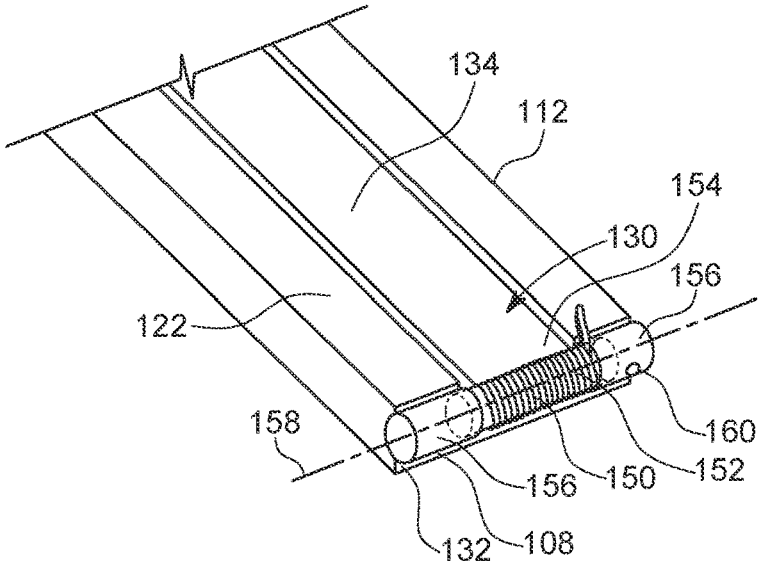
Figure 5:
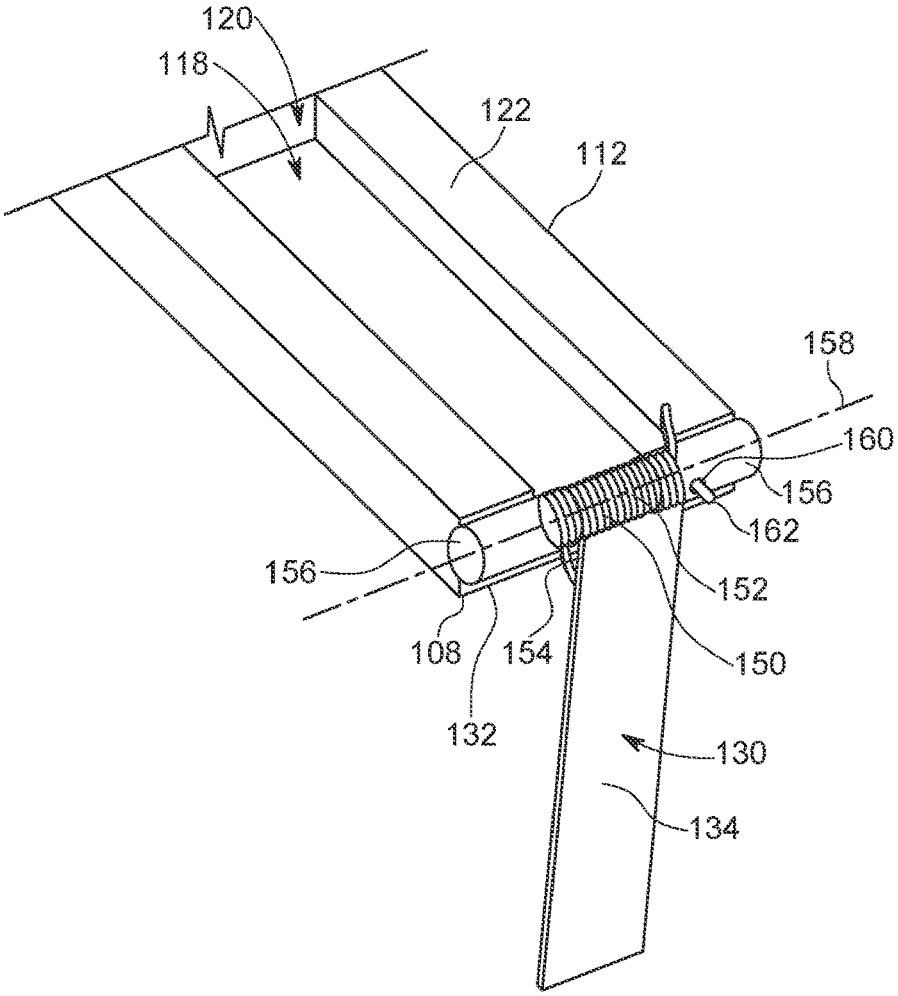

FIG. 4 illustrates a top schematic view of a portion of the stabilizer assembly depicting an elongated rod of the engagement structure arranged inside a groove of a first auxiliary tube of the telescopic rod, in accordance with an embodiment of the disclosure; and FIG. 5 illustrates a top schematic view of a portion of the stabilizer assembly depicting the elongated rod of the engagement structure arranged at a first position, in accordance with an embodiment of the disclosure.

DETAILED DESCRIPTION

In the following description, for purposes of explanation, numerous specific details are set forth in order to provide a thorough understanding of the present disclosure. It will be apparent, however, to one skilled in the art that the present disclosure can be practiced without these specific details. In other instances, apparatus and methods are shown in block diagram form only in order to avoid obscuring the present disclosure.

Reference in this specification to "one embodiment" or "an embodiment" means that a particular feature, structure, or characteristic described in connection with the embodiment is included in at least one embodiment of the present disclosure. The appearance of the phrase "in one embodiment" in various places in the specification are not necessarily all referring to the same embodiment, nor are separate or alternative embodiments mutually exclusive of other embodiments. Further, the terms "a" and "an" herein do not denote a limitation of quantity, but rather denote the presence of at least one of the referenced items. Moreover, various features are described which may be exhibited by some embodiments and not by others. Similarly, various requirements are described which may be requirements for some embodiments but not for other embodiments.

Some embodiments of the present disclosure will now be described more fully hereinafter with reference to the accompanying drawings, in which some, but not all, embodiments of the disclosure are shown. Indeed, various embodiments of the disclosure may be embodied in many different forms and should not be construed as limited to the embodiments set forth herein; rather, these embodiments are provided so that this disclosure will satisfy applicable legal requirements. Like reference numerals refer to like elements throughout. The use of any term should not be taken to limit the spirit and scope of embodiments of the present disclosure.

The embodiments are described herein for illustrative purposes and are subject to many variations. It is understood that various omissions and substitutions of equivalents are contemplated as circumstances may suggest or render expedient but are intended to cover the application or implementation without departing from the spirit or the scope of the present disclosure. Further, it is to be understood that the phraseology and terminology employed herein are for the purpose of the description and should not be regarded as limiting. Any heading utilized within this description is for convenience only and has no legal or limiting effect.

Figure 1:
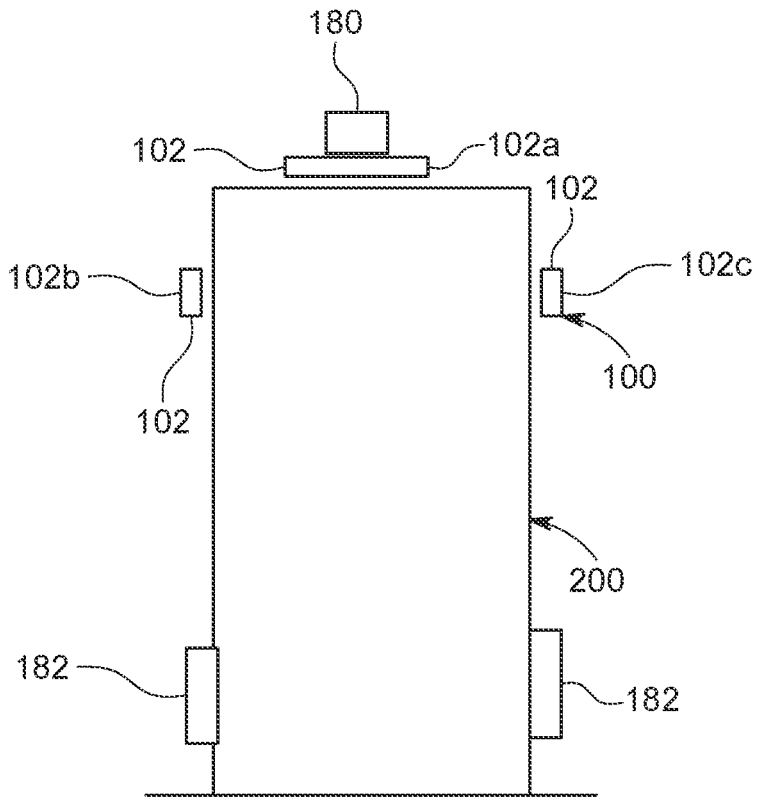
FIG. 1 illustrates a schematic view of a stabilizer system having three stabilizer assemblies arranged to prevent a tipping of a furniture, in accordance with an embodiment of the disclosure.

Referring to FIG. 1, a stabilizer system 100 to restrict or prevent tipping or overturning/falling of a furniture 200 standing on a surface, for example, a ground surface. The stabilizer system 100 includes at least one stabilizer assembly 102, for example, three stabilizer assemblies 102*a*, 102*b*, 102*c*, attached to at least one wall 300 of a building. It may be appreciated that each of the stabilizer assemblies 102*a*, 102*b*, 102*c* is similar in construction and assembly, therefore, for the sake of clarity and brevity, a construction and assembly only one stabilizer assembly 102*a* is described in detail. As shown, the stabilizer assembly 102*a* includes a telescopic rod 104 attached to the wall 300 and extending substantially perpendicularly to the wall 300. The telescopic rod 104 includes a first end 106 attached to the wall 300 and a second end 108 arranged distally from the wall 300. The telescopic rod 104 is adapted to be arranged between an extended position and a retracted position. In the extended position, the second end 108 of the telescopic rod 104 is arranged relatively distally from the wall 300, while in the retracted position, the second end 108 is arranged relatively proximally to the wall 300.

Figure 2:
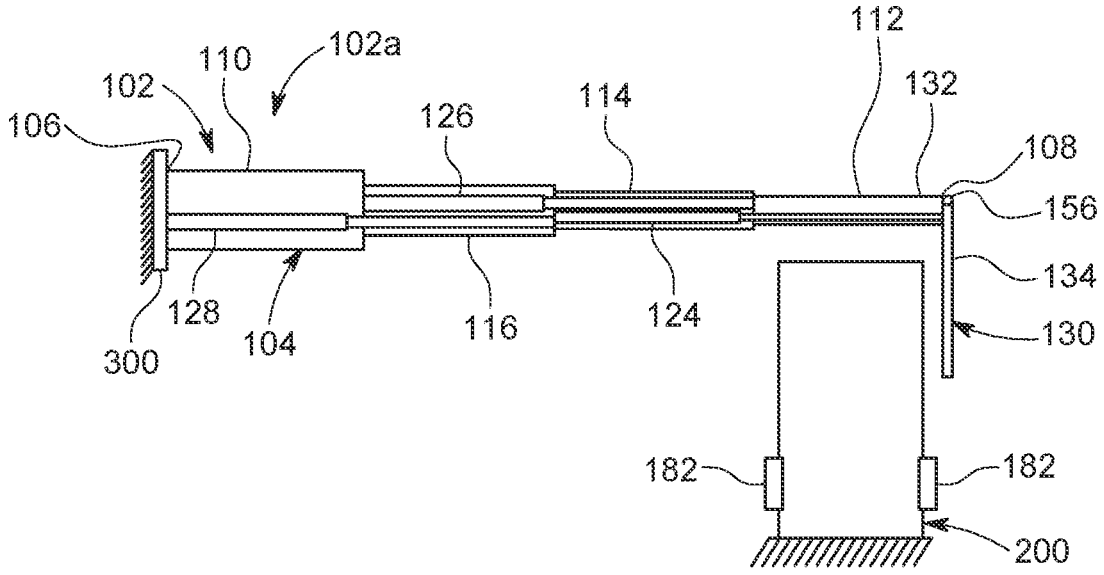
FIG. 2 illustrates a side schematic view of an example stabilizer assembly of FIG. 1 depicting a telescopic rod and an engagement structure arranged at an end of the telescopic rod with the engagement structure arranged in an expanded configuration, in accordance with an embodiment of the disclosure.
Figure 3:
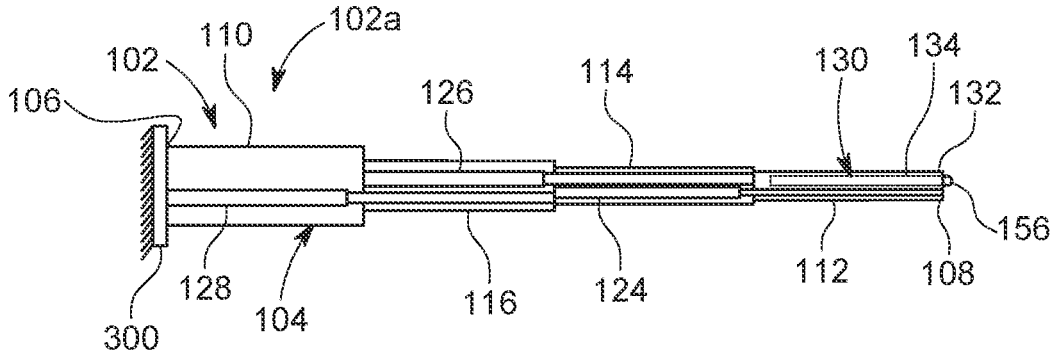
FIG. 3 illustrates a side schematic view of the stabilizer assembly of FIG. 2 depicting the engagement structure arranged in a stowed configuration, in accordance with an embodiment of the disclosure.

Referring to FIGS. 2 and 3, the telescopic rod 104 includes a main tube 110 fixedly attached to the wall 300 and at least one auxiliary tube telescopically coupled to the main tube 110 and configured to telescopically extend and retract relative to the main tube 110. In the illustrated embodiment, the at least one auxiliary tube includes a first auxiliary tube 112, a second auxiliary tube 114, and a third auxiliary tube 116. As shown, the third auxiliary tube 116 is arranged to telescopically extend and retract relative to the main tube 110, while the second auxiliary tube 114 is arranged to telescopically extend and retract relative to the third auxiliary tube 116. Moreover, the first auxiliary tube 112 is telescopically coupled to the second auxiliary tube 114 and configured to extend and retract relative to the second auxiliary tube 114. Although three auxiliary tubes 112, 114, 116 are shown and contemplated, it may be appreciated that the telescopic rod 104 may include a single auxiliary tube or more than two auxiliary tubes depending on a desired length of the telescopic rod 104 in the extended position. Also, as shown in FIG. 5, the first auxiliary tube 112 includes an axially extending groove 118 having an opening 120 defining by an upper surface 122 of the first auxiliary tube 112.

Further, as shown in FIGS. 2 and 3, to telescopically move the at least one auxiliary tube, the stabilizer assembly 102*a* includes at least one actuator operatively engaged with the telescopic rod 104. For example, in the illustrated embodiment, the stabilizer assembly 102*a* includes a first actuator 124 to telescopically extend the first auxiliary tube 112 relative to the second auxiliary tube 114, and a second actuator 126 to telescopically move/displace the second auxiliary tube 114 relative to the third auxiliary tube 116. Moreover, the stabilizer assembly 102*a* includes a third actuator 128 to telescopically extend and retract the third auxiliary tube 116 relative to the main tube 110. Accordingly, a number of actuators may vary depending on a number of auxiliary tubes of the telescopic rod 104. In an embodiment, the actuators 124, 126, 128 may be cylinders. In some embodiments, the actuators 124, 126, 128 may include linear screw actuators to linearly and telescopically move the auxiliary tubes 112, 114, 116.

Additionally, the stabilizer assembly 102*a* includes an engagement structure 130 attached to an end 132 of the first auxiliary tube 112 i.e., the second end 108 of the telescopic rod 104. The engagement structure 130 is configured to be arranged in an expanded configuration (shown in FIG. 2) and a folded/stowed configuration (shown in FIG. 3). In an embodiment, the engagement structure 130 is an elongated rod 134 rotatably attached to the end 132 of the first auxiliary tube 112 (i.e., second end 108 of the telescopic rod 104). The elongated rod 134 is adapted to be moved/displaced between a first position (shown in FIGS. 2 and 5) and a second position (shown in FIGS. 3 and 4) and is biased to the first position. In the first position, the elongated rod 134 extends substantially perpendicularly to the first auxiliary tube 112, while in the second position, the elongated rod 134 extends in the axial direction and is arranged substantially parallel to the first auxiliary tube 112 and inside the groove 118, as shown in FIG. 3 and FIG. 4, of the first auxiliary tube 112. To bias the elongated rod 134 in the first position, a spring 150, best shown in FIGS. 4 and 5, is arranged at a connection of the first auxiliary tube 112 with the elongated rod 134. The spring 150 is arranged to apply a biasing force on the elongated rod 134 to move the elongated rod 134 out of the groove 118 to the first position by displacing the elongated rod 134 between 250 degrees to 280 degrees relative to the first auxiliary tube 112 i.e., telescopic rod 104.

Further, referring to FIGS. 4 and 5, to rotatably couple the elongated rod 134 with the first auxiliary tube 112 i.e., the telescopic rod 104, the engagement structure 130 includes at least one first barrel 152 arranged at a first end 154 of the elongated rod 134, while the first auxiliary tube 112 includes at least one second barrel 156 arranged at the end 132 of the first auxiliary tube 112. End portion of first barrel 152 extends inside the second barrel to rotatably engaged/couple the elongated rod 134 with the first auxiliary tube 112 i.e., telescopic rod 14. It may be appreciated a diameter of the first barrel 152 is smaller than a diameter of the second barrel 156 to enable an insertion of a portion of the first barrel 152 inside the second barrel 156 and to enable the rotation of the first barrel 152 relative to the second barrel 156 about a central axis 158.

Further, to lock the elongated rod 134 relative to the first auxiliary tube 112 in the first position, the second barrel 156 defines a radial opening 160, and the engagement structure 130 includes a spring-loaded pin 162 (shown in FIG. 5) attached to the end portion of the first barrel 152 arranged inside the second barrel 156 and extending radially outwardly of the first barrel 152. The pin 162 is arranged to extend inside the opening 160 of the second barrel 156, when the elongated rod 134 is arranged at the first position, due to the biasing force of the spring of the spring-loaded pin, as shown in FIG. 5. The extension of the pin 162 inside the opening 160 prevents the rotation of the first barrel 152 relative to the second barrel 156 about the central axis 158, thereby locking the elongated rod 134 at the first position.

To move/displace the elongated rod 134 to the second position i.e., engagement structure 130 to the folded configuration, a rotation of the elongated rod 134 relative to the first auxiliary tube 112 i.e., rotation of the first barrel 152 relative to the second barrel 156 is to be enabled. For so doing, a user pushes the pin 162 and moves the pin 162 inside the second barrel 156 and out of the opening 160. Accordingly, to move the engagement structure 130 to the folded configuration, the pin 162 is moved out of the opening 160 by pressing the pin 162 in the radial direction, and then the user rotates the elongated rod 134 to the second position and arrange the elongated rod 134 inside the groove 118 of the first auxiliary tube 112. Thereafter, to keep the elongated rod 134 at the second position and inside the groove 118, the user displaces the first auxiliary tube 112 and retracts the first auxiliary tube 112 inside the second auxiliary tube 114. In an embodiment, the user manually pushes the first auxiliary tube 112 inside the second auxiliary tube 114 upon positioning/arranging the elongated rod 134 inside the groove 118.

To control the extension of the telescopic rod 104 and hence to control the at least one actuator, i.e., the first, second, and third actuators 124, 126, 128 the stabilizer system 100 includes a controller 180, shown in FIG. 1, arranged in communication with the actuators 124, 126, 128. The controller 180 is configured to actuate the actuators 124, 126, 128 to cause the extension of the telescopic rod 104 in response to a determination of a titling of the furniture 200 beyond a predefined angle. To determine the tilting, angle of tilting, and direction of the tilting of the furniture 200, the stabilizer system 100 includes a plurality of weight sensors 182, shown in FIGS. 1 and 2, connected to the furniture 200. The weight sensors 182 may be arranged proximate to a bottom of the furniture and may be arrayed along an outer periphery of the furniture 200. The weight sensors 182 are configured to detect/measure weight distribution of the furniture 200. It may be appreciated that a weight distribution changes when a tilting of the furniture 200 occurs or about to occur. Accordingly, the weight sensors 182 predicts/determines the tilting of the furniture 200 quickly. Also, based on the changes in the weight measured by each of the weight sensors 182, a direction of impending tilting of the furniture 200 is detected/determined. It may be appreciated that the weight distribution may change due to addition of a weight on the furniture 200. In some embodiments, the weight sensors 182 are configured to detect changes in the weight of the furniture 200.

In an embodiment, the controller 180 may detect the tilting or impending tilting of the furniture 200 in a forward direction based on the input from the weight sensors 182. The controller 180 determines the tilting or impending tilting of the furniture in response to the detect weight imbalance being above a predefined value. Based on such detection, the controller 180 operates the associated actuators 124, 126, 128 to fully extend the first auxiliary tube 112, the second auxiliary tube 114, and the third auxiliary tube 116. Due to extension of the first auxiliary tube 112 out of the second auxiliary tube 114, the elongated rod 134 is displaced to the first position due to the biasing force of the spring 150, and contacts the furniture 200. Also, as the elongated rod 134 moves to the first position, the pin 162 aligns with the opening 160 and extends through the opening 160 of the second barrel 156, locking the elongated rod 134 at the first position i.e., the engagement structure 130 in the expanded configuration, preventing the rotation of the elongated rod 134, thereby preventing the furniture 200 to tip/further tilt in the forward direction.

In some embodiments, the controller 180 may detect the tilting of the furniture 200 in one of the sidewise directions, for example, left hand side direction or right hand side direction. In such a case, the controller 180 may actuate the at least one actuator associated with the stabilizer assembly 102*b* or the stabilizer assembly 102*c* depending upon the direction of the tilting of the furniture 200. For example, the controller 180 actuates and extends the telescopic rod associated with the stabilizer assembly 102*b* in response to the determination of the tilting of the furniture 200 in the right hand side direction, and fully extend the telescopic rod 104 associated with the stabilizer assembly 102*c* when the furniture 200 tilts in the left hand side direction. In some embodiments, all the telescopic rods are actuated simultaneously irrespective of the direction of the tilting of the furniture 200.

To retract the telescopic rod 104 i.e., the auxiliary tubes 114, 116, the controller 180 actuates/operates the actuators 126, 128. Before the controller 180 actuates the actuators 126, 128, the controller 180 may determine the position of the first auxiliary tube 112 and the engagement structure 130 i.e., elongated rod 134, and actuates the actuators 126, 128 to retract the second and third auxiliary tubes 114, 116 when the elongated rod 134 is arranged at the second position and the first auxiliary tube 112 is arranged inside the second auxiliary tube 114. It may be appreciated that the elongated rod 134 is moved to the second position and the first auxiliary tube 112 is retracted, manually by a user, as described above. Thereafter, in some embodiments, the user may manually operate a switch to operate the actuators 126, 128 to retract the telescopic rod 104, and hence the auxiliary tubes 116, 114.

Many modifications and other embodiments of the disclosures set forth herein will come to mind to one skilled in the art to which these disclosures pertain having the benefit of the teachings presented in the foregoing descriptions and the associated drawings. Therefore, it is to be understood that the disclosures are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A stabilizer system, comprising:

at least one stabilizer assembly coupled to a wall and including a telescopic arm configured to telescopically extend and retract and having a first end attached to the wall and a second end arranged distally from the wall, and an engagement structure coupled to the second end of the telescopic arm and configured to be arranged in an expanded configuration and a stowed configuration and biased to the expanded configuration, wherein in the expanded configuration, the engagement structure is arranged to contact the furniture, and wherein the engagement structure includes an elongated arm rotatably attached to the second end of the telescopic arm and is adapted to move between a first position and a second position and is biased to the first position;

a plurality of weight sensors coupled to the furniture and configured to detect a weight imbalance of the furniture; and a controller arranged in communication with the plurality of weight sensors and the at least one stabilizer assembly and configured to extend the telescopic arm to engage the engagement structure with the furniture to prevent the tipping of the furniture in response to the detected weight imbalance being above a predefined limit.

2. The stabilizer system of claim 1, wherein the engagement structure includes a spring biasing the elongated arm to the first position.

3. The stabilizer system of claim 1, wherein in the expanded configuration, the elongated arm is arranged in the first position and is adapted to contact the furniture to prevent the tipping of the furniture, and in the stowed configuration, the elongated arm is arranged in the second position.

4. The stabilizer system of claim 1, wherein the telescopic arm includes a main tube and at least one auxiliary tube configured to telescopically extend and retract relative to the main tube, wherein the at least one auxiliary tube defines an axially extending groove and the elongated arm is arranged inside the groove, in the second position.

5. The stabilizer system of claim 4, wherein the engagement structure includes a spring-loaded pin coupled to the elongated arm and adapted to extend inside an opening of the at least one auxiliary tube in the first position of the elongated arm to prevent a rotation of the elongated arm relative to the at least one auxiliary tube.

6. The stabilizer system of claim 1 further including at least one actuator operatively coupled to the telescopic arm to extend and retract the telescopic arm.

7. The stabilizer system of claim 6, wherein the controller is arranged in communication with the at least one actuator and configured to operate the at least one actuator to control the extension and retraction of the telescopic arm based on input from the plurality of weight sensors.

8. A stabilizer system for controlling a tipping of a furniture, the stabilizer system comprising:

at least one stabilizer assembly coupled to a wall and including a telescopic arm having a main tube attached to the wall and at least one auxiliary tube arranged to telescopically extend and retract relative to the main tube, and an elongated arm pivotally coupled to the at least one auxiliary tube and adapted to pivot between a first position and a second position and is biased to the first position, wherein in the first position, the elongated plate is arranged to contact the furniture, wherein a spring biases the elongated arm to the first position;

a plurality of weight sensors coupled to the furniture and configured to detect a weight imbalance of the furniture; and a controller arranged in communication with the plurality of weight sensors and the at least one stabilizer assembly and configured to extend the telescopic arm to engage an engagement structure with the furniture to prevent the tipping of the furniture in response to the detected weight imbalance being above a predefined limit, wherein the engagement structure is coupled to the second end of the telescopic arm and configured to be arranged in an expanded configuration and a stowed configuration and biased to the expanded configuration.

9. The stabilizer system of claim 8, wherein the at least one auxiliary tube defines an axially extending groove and the elongated arm is arranged inside the groove, in the second position.

10. The stabilizer system of claim 8, wherein at least one stabilizer assembly includes a spring-loaded pin coupled to the elongated arm and adapted to extend inside an opening of the at least one auxiliary tube in the first position of the elongated arm to prevent a rotation of the elongated arm relative to the at least one auxiliary tube.

11. The stabilizer system of claim 8 further including at least one actuator operatively coupled to the at least one auxiliary tube to extend the at least one auxiliary tube.

12. The stabilizer system of claim 11, wherein the controller is arranged in communication with the at least one actuator and configured to operate the at least one actuator to control the extension of the at least one auxiliary tube based on input from the plurality of weight sensors.

* * * * *